US009888779B2

(12) United States Patent
Welsh

(10) Patent No.: US 9,888,779 B2
(45) Date of Patent: Feb. 13, 2018

(54) COVERING AND ENCLOSURE ASSEMBLY

(71) Applicant: Zachary Welsh, Rogers, TX (US)

(72) Inventor: Zachary Welsh, Rogers, TX (US)

( * ) Notice: Subject to any disclaimer, the term of this patent is extended or adjusted under 35 U.S.C. 154(b) by 116 days.

(21) Appl. No.: 15/095,257

(22) Filed: Apr. 11, 2016

(65) Prior Publication Data

US 2017/0290434 A1 Oct. 12, 2017

(51) Int. Cl.

| | |
|---|---|
| ***A47C 7/62*** | (2006.01) |
| ***A47G 9/02*** | (2006.01) |
| ***A47C 31/11*** | (2006.01) |
| ***A47C 31/00*** | (2006.01) |

(52) U.S. Cl.

CPC ..... *A47C 7/62* (2013.01); *A47C 31/001* (2013.01); *A47C 31/113* (2013.01); *A47G 9/0223* (2013.01)

(58) Field of Classification Search

None

See application file for complete search history.

(56) References Cited

U.S. PATENT DOCUMENTS

| | | | | |
|---|---|---|---|---|
| 4,302,046 | A * | 11/1981 | Lazazzero | A47C 7/62 224/275 |
| 4,724,558 | A | 2/1988 | Reiff | |
| 5,956,766 | A | 9/1999 | Benway | |
| D430,079 | S | 8/2000 | Catron-Batts | |
| 6,189,166 | B1 | 2/2001 | Braine et al. | |
| 6,851,127 | B1 | 2/2005 | Khan | |
| 7,076,816 | B1 * | 7/2006 | Nielsen | A47G 9/062 297/188.06 |
| 7,581,259 | B2 | 9/2009 | Thompson | |
| 2004/0158924 | A1 | 8/2004 | Frandsen-Anderson et al. | |
| 2005/0262613 | A1 | 12/2005 | Panek | |
| 2010/0263104 | A1 | 10/2010 | Flannery | |
| 2013/0207423 | A1 * | 8/2013 | Russell | B62J 1/20 297/188.2 |
| 2016/0347220 | A1 * | 12/2016 | Brown | A47G 9/068 |

* cited by examiner

*Primary Examiner* — David E Allred

(57) ABSTRACT

A covering and enclosure assembly for coupling a blanket to a back of a chair includes a shell defining an internal space. The shell is configured to couple to a back of a chair. A closure is coupled to and positioned in a front of the shell. A blanket is positioned in the internal space of the shell. The shell is configured to couple to a back of a chair. The closure is positioned in the front, such that the closure is configured for opening and closing. The blanket is configured to be accessed by a user through the closure.

19 Claims, 4 Drawing Sheets

COVERING AND ENCLOSURE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98.

The disclosure and prior art relates to covering and enclosure assemblies and more particularly pertains to a new covering and enclosure assembly for coupling a blanket to a back of a chair.

BRIEF SUMMARY OF THE INVENTION

An embodiment of the disclosure meets the needs presented above by generally comprising a shell defining an internal space. The shell is configured to couple to a back of a chair. A closure is coupled to and positioned in a front of the shell. A blanket is positioned in the internal space of the shell. The shell is configured to couple to a back of a chair. The closure is positioned in the front, such that the closure is configured for opening and closing. The blanket is configured to be accessed by a user through the closure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
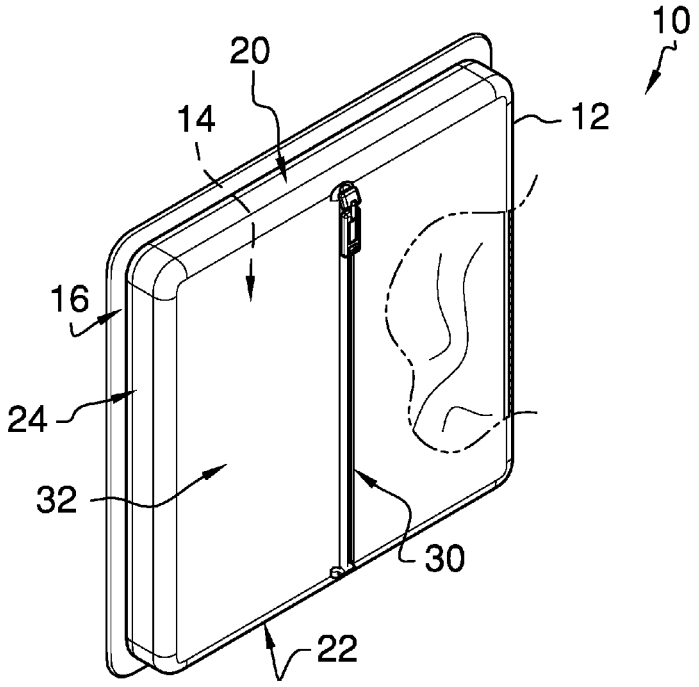
FIG. 1 is an isometric perspective view of a covering and enclosure assembly according to an embodiment of the disclosure.
Figure 2:
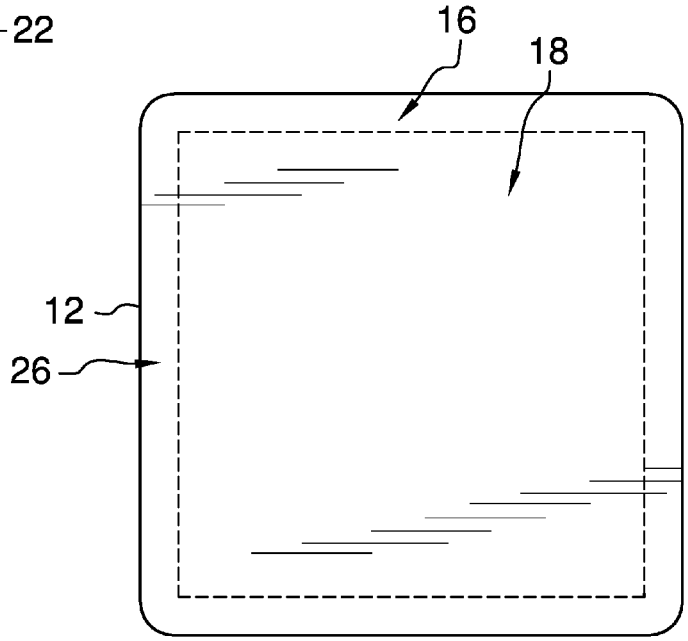
FIG. 2 is a back view of an embodiment of the disclosure.
Figure 3:
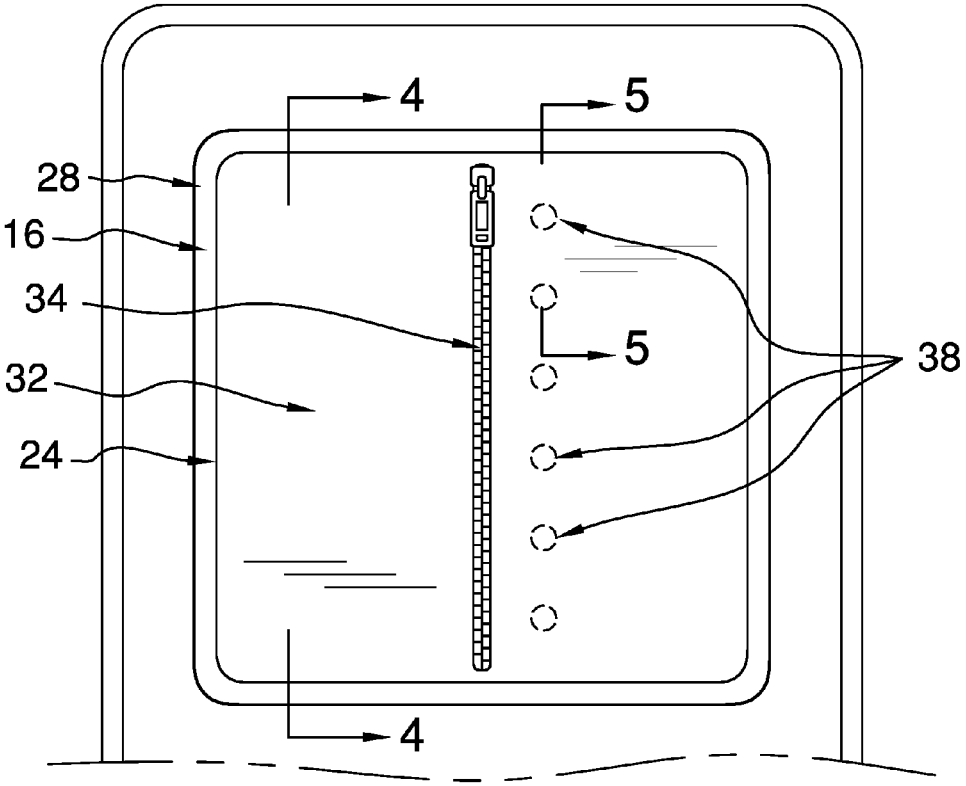
FIG. 3 is a front view of an embodiment of the disclosure.
Figure 4:
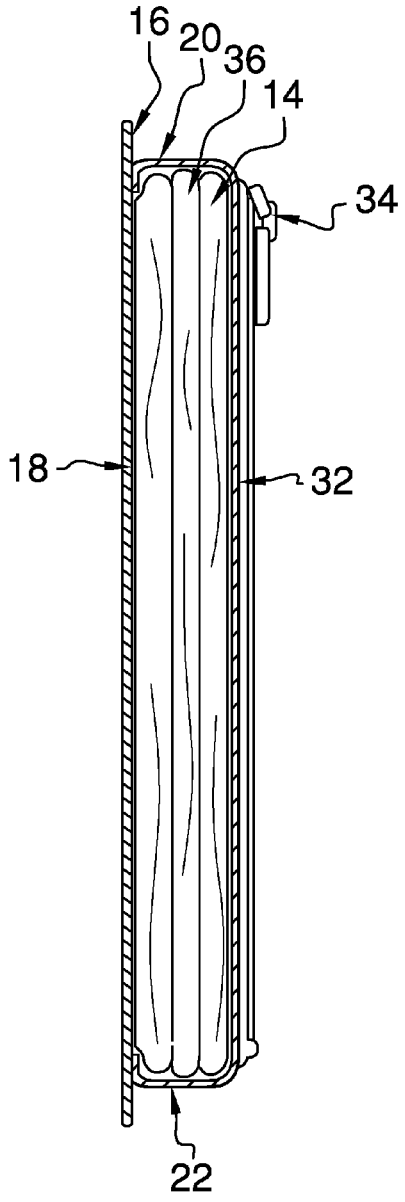
FIG. 4 is a cross-sectional view of an embodiment of the disclosure.
Figure 5:
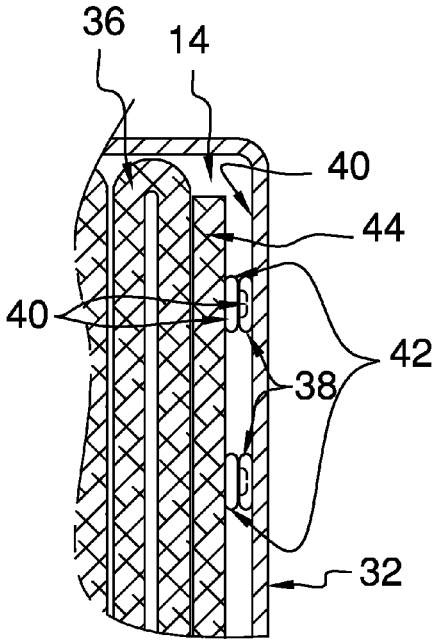
FIG. 5 is a cross-sectional view of an embodiment of the disclosure.
Figure 6:
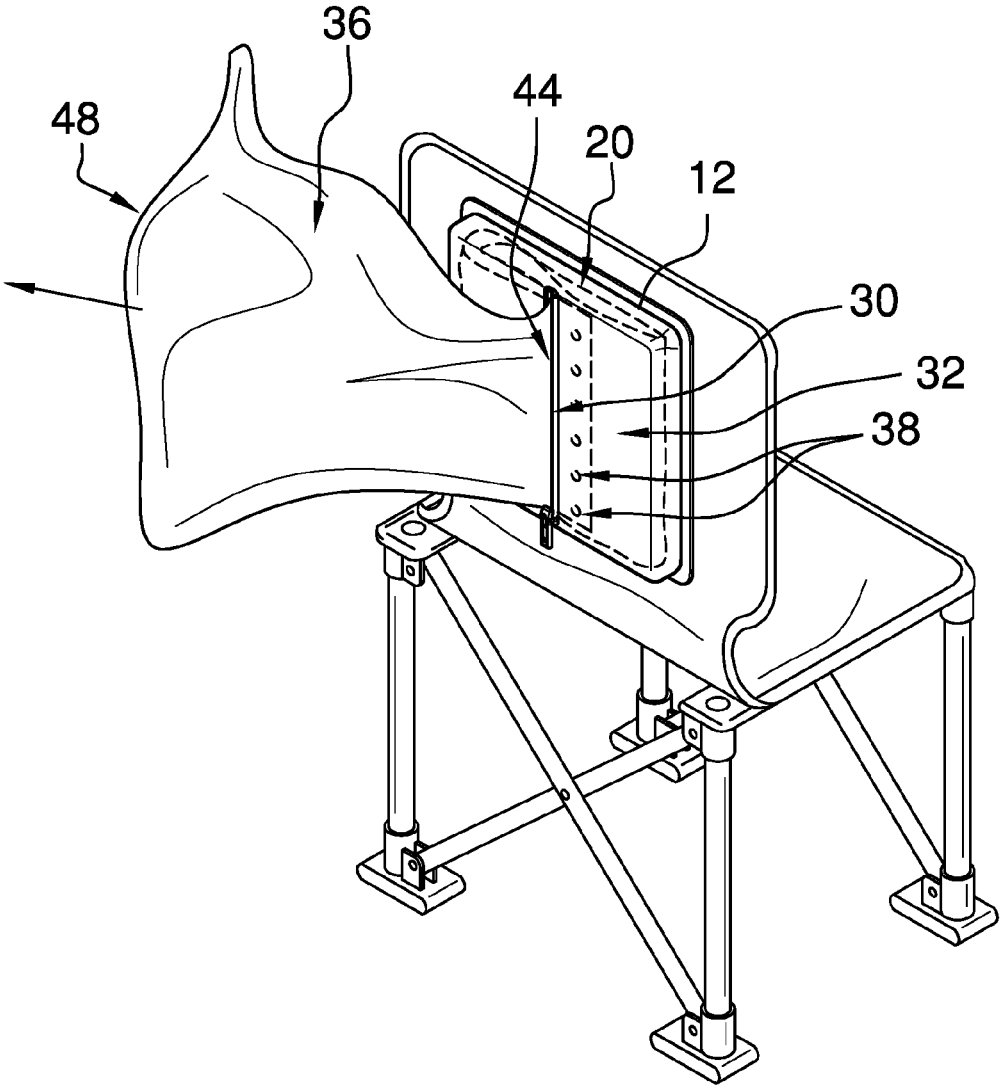
FIG. 6 is an in-use view of an embodiment of the disclosure.

With reference now to the drawings, and in particular to FIGS. 1 through 6 thereof, a new covering and enclosure assembly embodying the principles and concepts of an embodiment of the disclosure and generally designated by the reference numeral 10 will be described.

As best illustrated in FIGS. 1 through 6, the covering and enclosure assembly 10 generally comprises a shell 12 that defines an internal space 14. The shell 12 is configured to couple to a back of a chair. The shell 12 is water resistant. The shell 12 comprises canvas. The shell 12 is substantially rectangularly box shaped.

A rim 16 is coupled to the shell 12 proximate to a rear 18 of the shell 12. The rim 16 extends substantially perpendicularly from a top 20, a bottom 22 and opposing sides 24 of the shell 12. The rim 16 is configured to couple to the back of the chair.

A plurality of couplers 26 is coupled to the rim 16. The couplers 26 are configured to couple the rim 16 to the back of the chair. The plurality of couplers 26 comprises stitching 28.

A closure 30 is coupled to and positioned in a front 32 of the shell 12. The closure 30 extends from proximate to the top 20 to proximate to the bottom 22 of the shell 12. The closure 30 is positioned substantially equally distant from the opposing sides 24. The closure 30 comprises a zipper 34. The zipper 34 opens from proximate to the top 20 to proximate to the bottom 22.

A blanket 36 is positioned in the internal space 14 of the shell 12. The blanket 36 is water resistant. The blanket 36 is fire resistant. In one embodiment, the blanket 36 is both water and fire resistant. The blanket 36 comprises cloth.

A plurality of first fasteners 38 is coupled to an interior surface 40 of the shell 12. The first fasteners 38 are coupled to the front 32. The first fasteners 38 are positioned proximate to the closure 30. The first fasteners 38 are linearly positioned between the top 20 and the bottom 22 of the shell 12. The plurality of first fasteners 38 comprises six first fasteners 38.

A plurality of second fasteners 42 is coupled proximate to a first end 44 of the blanket 36. The second fasteners 42 are complementary to the first fasteners 38. The second fasteners 42 are positioned on the blanket 36 such that the second fasteners 42 are positioned to reversibly couple to the first fasteners 38 to reversibly couple the blanket 36 to the interior surface 40 of the shell 12. The plurality of second fasteners 42 is numerically equivalent to the plurality of first fasteners 38.

In one embodiment, each first fastener 38 and a respective second fastener 42 comprises a snap fastener 46. The snap fasteners 46 comprises metal. In another embodiment, the rear 18 is open, such that the shell 12 and the back of the chair define the internal space 14.

In use, the rim 16 of the shell 12 is configured to couple to a back of a chair. The closure 30, which is configured for opening and closing, is positioned in the front 32. The blanket 36 is configured to be accessed by a user through the closure 30 when the closure 30 is in an open position. A second end 48 of the blanket 36 is configured for extension through the closure 30, such that the blanket 36 is positionable over the user when the user is seated in the chair. The snap fasteners 46 are positioned to retain the first end 44 of the blanket 36 in the internal space 14 of the shell 12. The snap fasteners 46 also are configured for decoupling of the blanket 36 from the shell 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A covering and enclosure assembly comprising:

a shell defining an internal space, said shell being coupled to a back of a chair;

a closure coupled to and positioned in a front of said shell;

a blanket positioned in said internal space of said shell;

a plurality of first fasteners coupled to an interior surface of said shell, said first fasteners being coupled to said front of said shell more proximate to said closure than a lateral edge of said shell, and said first fastener being positioned on a vertical line between a top and a bottom of said shell; and wherein said blanket is configured for releasable attachment to the first fasteners, and wherein said closure is configured for opening and closing, such that said blanket is configured for accessing through said closure.

2. The assembly of claim 1, further including said shell being water resistant.

3. The assembly of claim 1, further including said shell comprising canvas.

4. The assembly of claim 1, further including said shell being substantially rectangularly box shaped.

5. The assembly of claim 4, further including a rim coupled to said shell proximate to a rear of said shell, said rim being annular, said rim extending substantially perpendicularly from a top, a bottom and opposing sides of said shell, said rim being coupled to the back of the chair.

6. The assembly of claim 5, further including a plurality of couplers coupled to said rim, said couplers being configured to couple said rim to the back of the chair.

7. The assembly of claim 6, further including said plurality of couplers comprising stitching.

8. The assembly of claim 1, further including said closure extending from proximate to said top to proximate to said bottom of said shell.

9. The assembly of claim 5, further including said closure being positioned substantially equally distant from said opposing sides.

10. The assembly of claim 9, further including said closure comprising a zipper, said zipper opening from proximate to said top to proximate to said bottom.

11. The assembly of claim 1, further including said blanket being water resistant.

12. The assembly of claim 1, further including said blanket being fire resistant.

13. The assembly of claim 1, further including said blanket being water and fire resistant.

14. The assembly of claim 1, further including said blanket comprising cloth.

15. The assembly of claim 1, further including;

a plurality of second fasteners coupled proximate to a first end of said blanket, said second fasteners being complementary to said first fasteners, said plurality of second fasteners being numerically equivalent to said plurality of first fasteners; and wherein said second fasteners are positioned on said blanket such that said second fasteners are positioned to releasably couple to said first fasteners to releasably couple said blanket to said interior surface of said shell.

16. The assembly of claim 1, further including said plurality of first fasteners comprising six said first fasteners.

17. The assembly of claim 1, further including each said first fastener and a respective one of said second fasteners comprising a snap fastener; said snap fasteners comprising metal.

18. The assembly of claim 1, further including said rear being open, wherein said shell and the back of the chair define said internal space.

19. A covering and enclosure assembly comprising:

a shell defining an internal space, said shell being coupled to a back of a chair, said shell being water resistant, said shell comprising canvas, said shell being substantially rectangularly box shaped;

a rim coupled to said shell at a rear of said shell, said rim being annular, said rim extending substantially perpendicularly from a top, a bottom and opposing sides of said shell, said rim being configured to couple to the back of the chair;

a plurality of couplers coupled to said rim, said couplers being configured to couple said rim to the back of the chair, said plurality of couplers comprising stitching;

a closure coupled to and positioned in a front of said shell, said closure extending from proximate to said top to proximate to said bottom of said shell, said closure being positioned substantially equally distant from said opposing sides, said closure comprising a zipper, said zipper opening from proximate to said top to proximate to said bottom;

a blanket positioned in said internal space of said shell, said blanket being water resistant, said blanket being fire resistant, said blanket comprising cloth;

a plurality of first fasteners coupled to an interior surface of said shell, said first fasteners being coupled to said front, said first fasteners being positioned proximate to said closure, said first fasteners being positioned on a vertical line between said top and said bottom of said shell, said plurality of first fasteners comprising six said first fasteners;

a plurality of second fasteners coupled proximate to a first end of said blanket, said second fasteners being complementary to said first fasteners, wherein said second fasteners are positioned on said blanket such that said second fasteners are positioned to releasably couple to said first fasteners to releasably couple said blanket to said interior surface of said shell, said plurality of second fasteners being numerically equivalent to said plurality of first fasteners;

each said first fastener and a respective said second fastener comprising a snap fastener, said snap fasteners comprising metal;

said rear being open, wherein said shell and the back of the chair define said internal space; wherein said closure is configured for opening and closing, such that said blanket is configured for accessing through said closure.

* * * * *